United States Patent [19]

Elsworth

[11] 4,315,532

[45] Feb. 16, 1982

[54] APPARATUS FOR FILLING CAULKING TUBES WITH IMPROVED LINKAGE MEANS

[75] Inventor: Robert M. Elsworth, 330 Albany-Shaker Rd., Loudonville, N.Y. 12211

[73] Assignee: Robert M. Elsworth, Loudonville, N.Y.

[21] Appl. No.: 33,830

[22] Filed: Apr. 27, 1979

[51] Int. Cl.[3] ..... B65B 43/56

[52] U.S. Cl. ..... 141/183; 74/833; 141/186; 141/191; 222/380

[58] Field of Search ..... 74/828, 831, 833; 92/13.7; 141/129, 177, 183–191, 237, 238, 242, 392; 222/309, 380

[56] References Cited

U.S. PATENT DOCUMENTS 2,315,162 3/1943 Rasmussen ..... 222/380 X

*Primary Examiner*—Frederick R. Schmidt

*Attorney, Agent, or Firm*—E. Philip Koltos

[57] ABSTRACT

An apparatus for filling caulking tubes with a liquid composition with improved linkage and adjusting mechanisms for determining the amount of composition that is placed into the caulking tubes.

26 Claims, 9 Drawing Figures

104
110
122
312
314
92
140
322
314
342
340
132
160
380
382
350
354
360
352
370
372
290
400
230
304
82
262
272
404
294
282
278
284
292
296
402
222
220
306
300
240
406
216
224
280
80
210
212
36
200
202
204

APPARATUS FOR FILLING CAULKING TUBES WITH IMPROVED LINKAGE MEANS

BACKGROUND OF THE INVENTION

The present invention relates to machines for filling caulking tubes and more particularly the present invention relates to improved adjusting means for filling caulking tubes where the improved adjusting means can be utilized to indicate or set with accuracy the amount of material that is forced into the empty caulking tubes.

Caulking tubes are well known. Such caulking tubes usually comprise a body portion which is a cylindrical body with a plunger cap at the rear end of the caulking tube and a protruding nozzle on the other end of the caulking tube.

When it is desired to utilize the caulking tube, the forward end of the nozzle is cut and the caulking tube is placed in a caulking gun wherein a ram acts against the plunger at the rear end of the caulking tube to force material out of the cut portion of the nozzle at the forward end of the caulking tube. Various types of materials and compositions are packaged in caulking tubes such as, for instance, liquid compositions or compositions with the consistency of grease. Examples of compositions that can be packaged in caulking tubes are grease, latexes, paints and sealant compositions. These are a few of the types of compositions that can be utilized or can be packaged in caulking tubes.

As can be appreciated, sealant compositions are one type of compositions which have wide application in the construction industry and are normally packaged in caulking tubes for use by the construction worker on the job. One type of sealant which is packaged in caulking tubes is silicone compositions. With respect to certain silicone compositions, it is desirable that such compositions be packaged and sold in an anhydrous state and then when the caulking tube seal is broken and the composition is exposed to atmospheric moisture the composition cures to a silicone elastomer. These silicone compositions which have found widespread use as construction sealants and are packaged in caulking tubes are one-component room temperature vulcanizable silicone rubber compositions and such compositions are normally packaged in a caulking tube so as to prevent the contact of atmospheric moisture with the composition except when it is desired to cure the composition.

As the case may be, there is shown in FIG. 1 of the instant application the improved caulking tube filling apparatus of the instant case. Such apparatus, as can be seen in FIG. 1, generally comprises a drive means for driving the main drive shaft over which there is driven a conveyor belt containing empty caulking tubes. The main drive shaft which is located at the lower part of the apparatus also drives through a lower drive lever which reciprocates in a yoke which forms a portion of the instant invention; and an upper drive lever which reciprocates six piston and six cylinders. As will be explained in the instant case, material from the reservoirs at the top of the apparatus, as can be seen in FIG. 1, flows by gravity feed and by the suction created in the six pistons and cylinders into the cavities in the six cylinders when the pistons retract and then when the pistons are forced into the cylinders the composition in the cylinders is forced through the passage tubes, shown in the drawing, onto the empty caulking tubes located directly beneath the passage tubes.

In another part of the apparatus of the instant case, there is a mechanism for fitting and forcing plunger caps into the rear end of the filled caulking tubes, six at a time, so as to seal the compositions in the caulking tubes. It should be noted that the apparatus of the instant case fills six caulking tubes at a time with the composition of the instant case and that the conveyor belt, by linkage which is not shown, presents six caulking tubes at a time under the passage tubes and by synchronization which is well known in the art, the composition is emptied from the six cylinders into the passage tubes and into the six empty caulking tubes at the appropriate time so as to fill the six caulking tubes with composition such as will be explained herein below.

The amount of material that is forced out of the six cylinders into the caulking tubes depends on the amount of travel in the reciprocation of the upper drive lever and the linkage shown in the right hand side of FIG. 1. The amount of reciprocation in the upper drive lever of FIG. 1, determines the amount of reciprocation of the six pistons in the six cylinders and accordingly determines the amount of composition that is imparted into the empty caulking tubes.

It should be noted that there were various ways and means in the prior art caulking tube filling machines and other types of machines for determining the amount of travel in the upper drive levers or arms of FIG. 1. Cantilever adjusting means were used for adjusting such linkages at one end of the machine, however, such cantilever means for adjusting the amount of travel in the upper drive arm or lever caused inaccuracies in terms of the filling of the caulking tubes since the cantilever was subject to deflection and accordingly gave an inaccurate adjustment to the travel of the upper drive lever. Accordingly, some innovators in the field put some cantilever beam arrangements on both sides of the machine. However, such caused difficulties in two respects.

First, the cantilever adjustment means was still subject to deflection because of the cantilever nature of the adjusting mechanism and secondly, it was difficult to synchronize the adjusting means on one side of the apparatus with the adjusting means on the other side of the apparatus.

Another means for measuring the adjustment of the travel of such upper drive lever or reciprocation of the upper drive lever was to use a plate with a screw. However, it was found that with the amount of space permitted for the screw, it was not possible to get a screw of sufficient diameter to absorb the stresses, and accordingly, the screws and the plates that were utilized in such adjusting means would fail because the screw would be unable to take the pressure that was generated by the machine.

It should be noted that in this respect that caulking tube filling machines are normally utilized to fill compositions such as latexes, greases and other compositions being either of low viscosity or high viscosity but not being of the consistency of silicone compositions. It has been found that silicone compositions will tax the maximum load requirements of typical caulking tube filling machines and will create many difficulties because of the high viscosity of the silicone compositions and accordingly the high amount of stresses that are built in the machine when such prior art machines are utilized to fill caulking tubes with silicone compositions.

Accordingly, in addition to the fact that the adjusting means of the prior art machines were inadequate to adjust the reciprocation of the upper drive lever when the machine was utilized to fill caulking tubes with silicone compositions, it was found that such apparatus and specifically the linkage means similar to the one shown at the right of FIG. 1, would result in undue wear in the moving part of the apparatus or undue wear would be created in the moving parts of the linkage means shown in FIG. 1. Accordingly, the bronze, steel and other types of machine shafts and arms would normally be greased or lubricated with various lubricating oils and greases would still unduly wear very rapidly due to the high load placed on the machine when it was utilized to fill silicone compositions in caulking tubes. Accordingly, it was highly desirable to find means which would reduce the wear between moving parts in the linkage means shown to the right of FIG. 1.

As an example of the additional load that is necessary or work that has to be done to fill caulking tubes with silicone compositions as compared to other prior art compositions, it should be noted that a three-fourths horsepower motor could be utilized to run a prior art caulking tube filling machine for filling greases and latexes in caulking tubes, but a five horsepower motor is required to run a caulking tube filling machine for filling silicone compositions into caulking tubes.

Accordingly, it is one object of the present invention to provide an improved adjusting means for adjusting the travel of the feed means which will determine with accuracy the amount of composition that will be fed into the empty caulking tube in the caulking tube filling machine.

It is an additional object of the present invention to provide for a sturdy and very accurate adjusting means in the caulking tube filling machine for feeding liquid compositions into the caulking tubes where the adjusting means determines with accuracy and precision the amount of travel of the pistons and the cylinders in the feed means for feeding liquid compositions into empty caulking tubes.

It is yet an additional object of the present invention to provide for a sturdy and accurate adjusting means for determining the amount of travel or reciprocation of a driven lever which is driven by a cam and lever means which amount of travel is adjusted with precision and which amount of travel of the driven arm is determined with precision and accuracy.

It is yet still an additional object of the present invention to provide for means in linkages in caulking tube filling machines for reducing the wear between the moving parts in the linkages.

These and other objects of the present invention are accomplished by means of the apparatus set forth in the Figures below.

FIGURES

Figure 1:
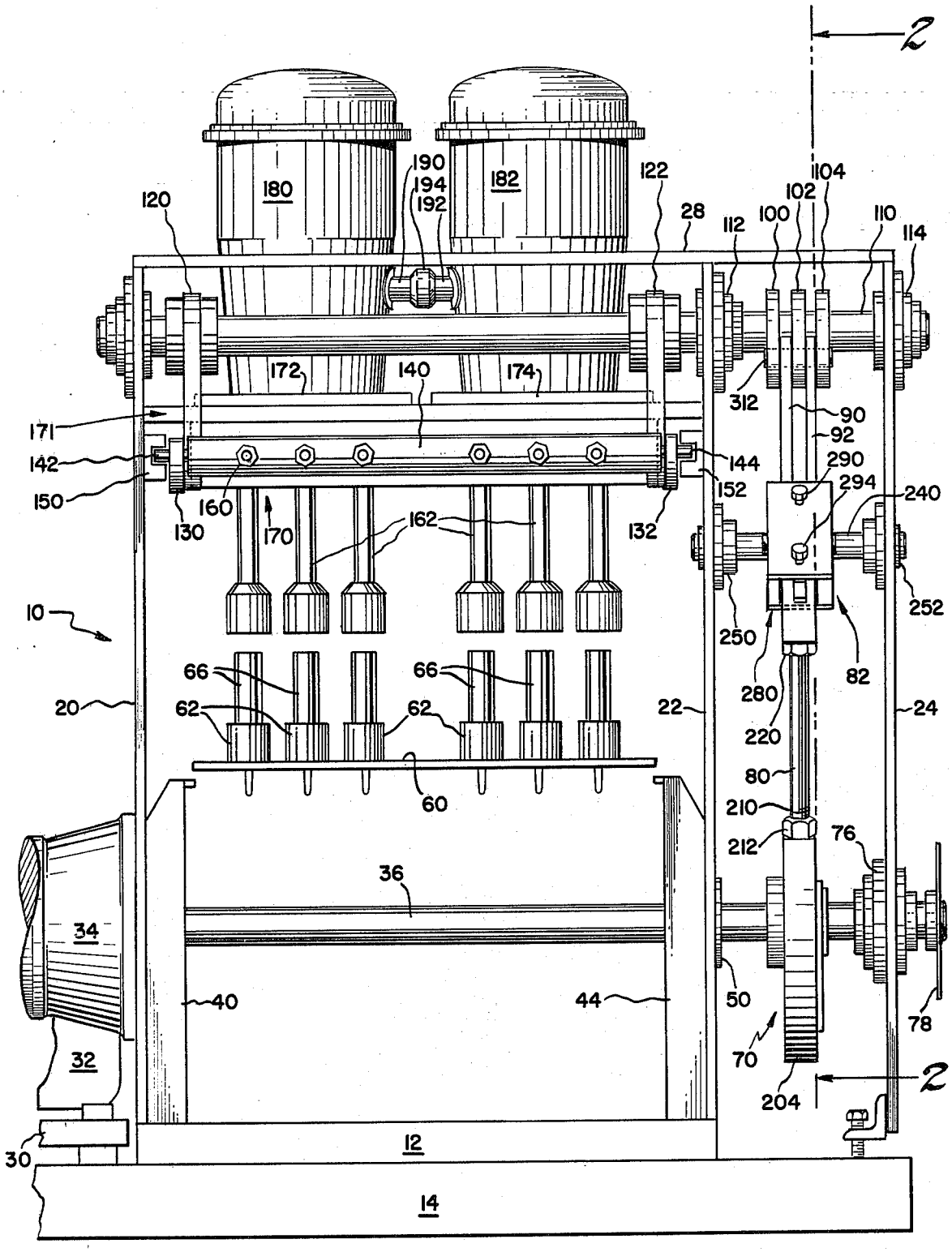
FIG. 1 is an end view of the preferred caulking tube filling machine apparatus of the instant case.

These and other aspects of the Figures of the instant invention discussed above are set forth by the disclosure set forth herein below.

SUMMARY OF THE INVENTION

In accordance with the above objects and Figures there is provided by the present invention an apparatus for filling caulking tubes with liquid compositions and with improved adjusting means for determining the amount of liquid composition to be placed in the caulking tube, comprising, a frame;

a drive means in the lower end of such frame for driving the conveyor belt means with empty caulking tubes placed thereon;

linkage means on one side of said frame and driven by said drive means and having adjusting means therein;

feed means being driven by said linkage means for passing said liquid composition into the empty caulking tubes on said conveyor belt means wherein the amount of said composition placed in said caulking tubes is determined by the travel of said linkage means wherein said linkage means and adjusting means comprises a cam and lever means driven by said drive means said cam and lever means connected to said drive in cam and said adjusting means which is a plate means which reciprocates at its rear end on a fixed shaft surrounded by box means such that the upper drive lever which drives the feed means is connected in a fixed position on said box means but slidably connected to said plate means such that the cam and lever means will drive the forward end of said plate means which motion will be transmitted to said upper lever to reciprocate said upper drive lever in a reciprocating motion and the amount of said reciprocating motion transmitted to said upper drive lever will depend on the lateral position of said plate means and said box means which determines the amount of travel of said upper drive lever about the fixed shaft to which said plate means is connected.

Further, ball bushings are utilized to connect said cam and lever means connecting to said adjusting means and said upper drive lever means connected to said adjusting means and also preferably said cam and said main drive shaft rotates in the ball bearings located in the cam follower which drives the main lower drive lever in a reciprocating motion which in turn drives the upper main upper drive lever in a reciprocating motion which in turn drives the feeding mechanism for the apparatus.

DESCRIPTION OF THE PREFERRED EMBODIMENT

The present invention may be utilized or the adjusting means of the present invention may be utilized in caulking tube filling machines or other apparatus in which it is necessary to restrict or measure the amount of travel of a particular lever. The present invention is particularly suited to the measurement of travel in a lever in a caulking tube filling machine, so as to set accurately and definitely the amount of material that is inserted into the caulking tubes by the machine. The caulking tube filling machine in which the improved adjusting means and linkage means of the instant case is utilized may be utilized in caulking tube machines which fill caulking tubes with various types of compositions such as, latexes, paints, greases and various other types of compositions.

Preferably, the caulking tube machine of the instant case is utilized to fill caulking tubes with silicone compositions and more preferably with one-component room temperature vulcanizable silicone rubber compositions. Such compositions generally comprise as the basic ingredient, a silanol-terminated diorganopolysiloxane polymer having a viscosity varying from 500 to 1,000,000 centipoise at 25° C., where the organo groups are selected from monovalent hydrocarbon radicals and a filler which may be selected from many reinforcing and extending fillers, examples of the reinforcing filler being fumed silica and precipitated silica, and examples of the extending filler being lithopone, zinc oxide, iron oxide, diatomaceous earth, and etc. To this basic composition there is then added the desired quantity of cross-linking agent which may be an alkoxy functional silane or an acyloxy functional silane. For the acyloxy functional silane, preferably the cross-linking agent will be methyltriacetoxysilane along with which there is added a metal salt of a carboxylic acid with the metal ranging from lead to manganese in the Periodic Table. Most preferably, the catalyst is a tin salt of a carboxylic acid such as, dibutyl tin dilaurate. When an alkoxy functional silane is utilized, then generally there is utilized methyltrimethoxysilane as the cross-linking agent with a titanium chelate as the catalyst. Preferably, there is utilized per 100 parts of the silanol polymer from 5 to 200 parts by weight of the filler, from 1 to 15 parts by weight of the cross-linking agent, and from 0.01 to 5 parts by weight of the catalyst. To this basic composition there may be added other additives such as, adhesion promoters such as, for instance, ditertiary butoxy, diacetoxysilane or the silyl isocyanurates as adhesion promoters and various flame retardant additives, as well as other additives which are added for one reason or another.

To produce the composition, the composition is packaged in a substantially anhydrous state, preferably with the preferred caulking tube filling machine of the instant case and sold as such. When it is desired to utilize the composition, the seal on the nozzle of the caulking tube is broken, the composition is applied and exposed simultaneously to atmospheric moisture whereupon the atmospheric moisture will cause it to cross-link and form a silicone elastomer.

Accordingly, the caulking tube filling machine of the instant case is preferably utilized to fill caulking tubes with one-component room temperature vulcanizable silicone rubber compositions such as above. It should be noted that the caulking tube filling machine in the preferred embodiment is not limited to filling caulking tubes only with acyloxy and alkoxy functional silane cross-linking agents in a composition. There may be utilized other cross-linking agents in the composition such as, aminoxy functional cross-linking agents, amine functional silane cross-linking agents, and amide functional silane cross-linking agents. However, for practical purposes, the acyloxy functional silane cross-linking agent one-component room temperature vulcanizable silicone rubber composition and the alkoxy functional silane cross-linking agent compositions are the most common. However, it should be noted that the instant invention is not only limited solely to caulking tube filling machines which are utilized to fill caulking tubes with silicone compositions or with one-component room temperature vulcanizable silicone rubber compositions, but may be utilized to fill caulking tubes with other types of compositions.

The caulking tube filling machine of the instant case is especially desirable for filling caulking tubes with viscous compositions since it is capable of taking a much higher load for the packaging of viscous liquid compositions in caulking tubes.

Proceeding to FIG. 1, frame (10) of the apparatus has a bottom side (12) which rests on three supporting channels (14) welded to (12) which rests on the ground and has sides (20), (22) and (24) with top of the frame being (28). There is also platform (30) on ground (14) holding motor (32) which drives gears in gear box (34) which in turn drives main central drive shaft (36). Main central drive shaft (36) is supported on side (20) by bracket (40) and side (22) by bracket (44) and turns in side (20) through bearings (not shown), and side (24) through bearings (50). Main drive shaft (through means not shown) drives conveyor belt (60) on which are receptacles (62) which carry caulking tubes (66) thereon, carrying six caulking tubes at a time to be filled by the caulking tube filling machine. The means by which main drive shaft (36) propels conveyor belt (60) is not shown in the drawing and will not be discussed since it forms no part of the instant invention. Main drive shaft (36) also drives cam and cam follower (70) which will be discussed in detail below, main drive shaft (36) riding in bearing surfaces (76) in side (24). Main drive shaft (36) also has sprocket wheel (78) attached to its end for purposes not pertinent to the instant invention and as such will not be discussed in detail. Cam follower (70) driven by main drive shaft (36) also drives lower drive lever (80) and through adjusting means (82) drives upper drive levers (90) and (92) retained in position by collars (100), (102) and (104), so as to drive or reciprocate secondary drive shaft (110). Secondary drive shaft (110) rides in sides (22) through bearing surfaces (112) on side (22) and bearing surfaces (114) on side (24). Secondary drive shaft (110) drives rocker arms (120), (122), (130) and (132) which are connected to cylinder (140) through pins (142) and (144) which ride in slots in channel members (150) and (152). Channel members (150) and (152) are utilized so as to let pins (142) and (144) ride so that the levers (130) and (132) will move in the correct path so as to activate cylinder (140) in a substantially linear motion. The function of cam and cam follower (70) in adjusting means (82) as well as rocker arms (90) and (92) with the other linkages that were explained above, will be set forth more fully in detail below.

Figures 2, 3, 4:
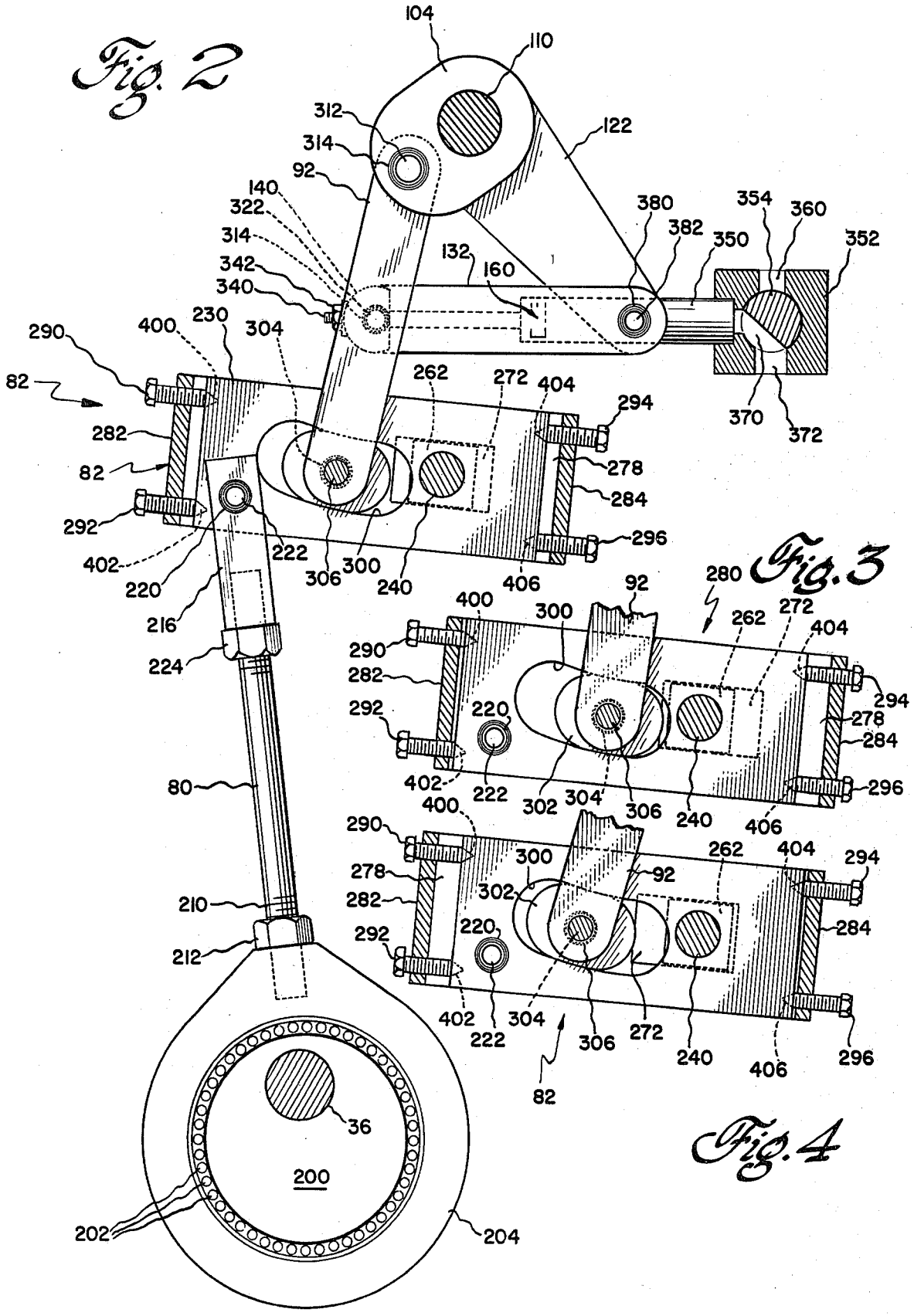
FIG. 2 is a partially cross-sectional/partially skematic view of the improved linkage and adjusting means of the instant invention which is taken along lines 2—2 of FIG. 1.
FIG. 3 is a cross-sectional view, similar to that of FIG. 2, but not showing as much of the apparatus as FIG. 2, showing the adjusting means with the box means in the adjusting means moved to the right.
FIG. 4 is a cross-sectional view showing the adjusting means wherein the box means in the adjusting means is with the box means moved to the left.

However, to get an overall view of the machine it is appropriate to look at the fact that cylinder (140) drives six pistons and cylinders (only shown at (160) FIG. 2) so as to force the silicone compositions out of passage tubes such as, passage tube (162), into empty caulking tube (66). The other passage tubes have not been numbered since their function is exactly the same as that of passage tube (162) and caulking tube (66).

The only other point to be noted is that in that portion of the piston and cylinder shown generally at (160) on FIG. 2, there is also a block and core shaft means (352) partially shown at (170) in FIG. 1 (whose function will be explained below) above which there is support plate (171) carrying bases (172) and (174) of reservoirs (180) and (182). The function of reservoirs (180) and (182) is to obtain composition from a central reservoir (not shown) and allow it by inert gas pressure feed and pressure from reservoirs (180) and (182) to feed into the pistons and cylinder means which were referred to at (160), and whose function will be explained more fully below. Since reservoirs (180) and (182) are connected by pipes (190) and (192) through sleeve (194) such that pressure sensing means in the end vessel indicates that both the vessels are low in composition and then the composition from the supply source can feed both vessels and into the cylinders and pistons generally shown at (160), for the purpose of filling the caulking tubes by passing through passage tube (162). An alternate function of reservoirs (180) and (182) is that by having the appropriate sensing means in each reservoir and with the reservoirs not connected they can function independently, each filling their one-half of the tubes on the conveyor.

Figure 5:
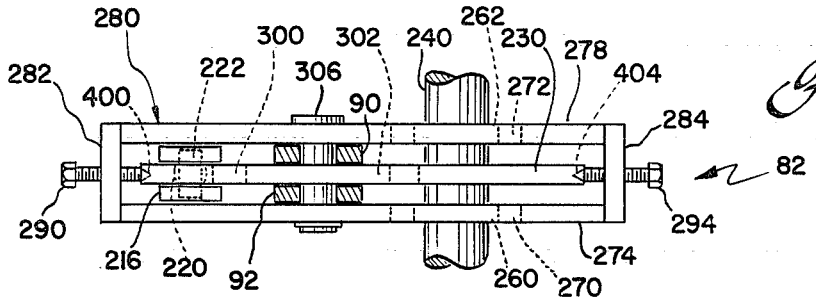
FIG. 5 is a top view of the adjusting means of the instant invention.
Figure 6:
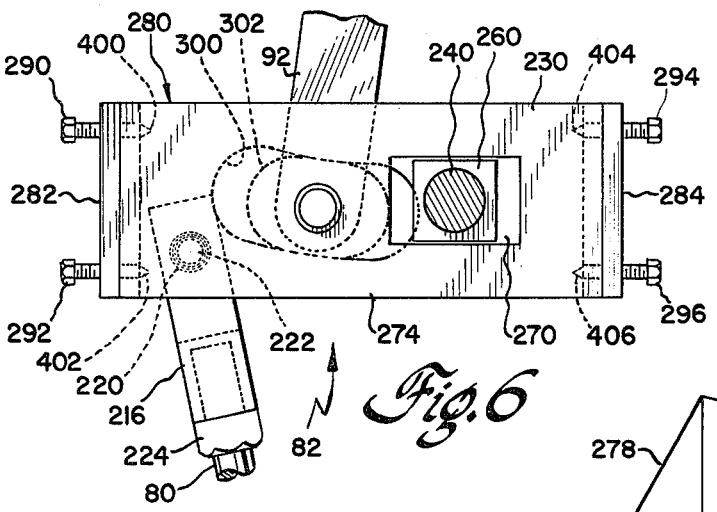
FIG. 6 is a side view of the adjusting means of the instant invention.
Figure 7:
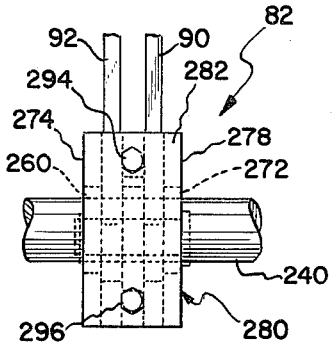
FIG. 7 is a front view of the adjusting means of the instant invention.

Now, proceeding to FIGS. 2, 3 and 4 for a more fuller visualization of the mechanism at (70), (82) and the rocker arms in upper drive levers (90) and (92). The main drive shaft (36) is shown in FIG. 2 moving in a contra-clockwise direction. There is attached a cam (200) which moves along with shaft (36) and with the appropriate ball bearing sleeve (202) in cam follower (204). By such motion, shaft (36) causes lower drive lever (80) to reciprocate. Lower drive lever (80) is attached by threaded portions (210) into cam follower (204) and is maintained in position by nut (212). The upper portion of lower drive lever (80) also screws into yoke (216) and is fixed in position by nut (224). As is clearly shown in FIGS. 5, 6, 7 and 8, yoke (216) is attached by two ball bushing (220) appended to shaft (222) to plate (230) in adjusting means (82). Plate (230) in adjusting means (82) has a fixed shaft (240) attached to its right portion in which plate (230) is fixedly attached to shaft (240) such that the plate rotates with the shaft. Shaft (240) is fixedly attached to sides (22) and (24) through bearings (250) and (252). It can be seen in FIGS. 5 and 6 and also 8, fixed shaft (240) has blocks (260) and (262) which rides in rectangular openings (270) and (272) in sides (274) and (278) in box (280). Box (280) has end sides (282) and (284) through which pass two screws on each end side, screw (290) and (292) in side (282) and screws (294) and (296) are in side (284). Screws (290), (292), (294) and (296) determine the position of fixed plate (230) with respect to box (280). It should be noted, plate (230) is fixed in any adjustment with screws (290), (292), (294) and (296) and what moves is box (82) relative to plate (230). In addition, plate (230) has an eliptical opening (300) (as seen in FIG. 2) in which rides oval member (302) which is connected by a ball bushing (304) through pin (306) to upper drive levers (90) and (92). Upper drive levers (only one of which is shown in FIG. 2) is connected to rocker arm (122) through pin (312) in ball bushing (314), so as to propel rocker arm (122) in a reciprocating motion. Rocker arm (122) drives drive lever (132) in an essentially linear motion so as to drive cylinder (140) (shown in dotted line in FIG. 2). Lever (132) is connected to cylinder (140) through bushing (320) and pin (322). Cylinder (140) has passing through it a rod (340) which is connected to the end of the cylinder through nut (342) which rod (340) drives a piston in cylinder (350). The end of cylinder (350) is appended to block (352) in which rides core member (354). Accordingly, when rocker arm (122) is motivated by the appended linkages (as will more fully be explained below), there is moved to the left in FIG. 2, a rod (340) which will extend to the left pulling the piston out of cylinder (350) which will cause liquid composition from reservoirs (180) and (182) to flow through opening (360) into cylinder (350), core means (354) having a cavity therein so as to allow a passageway between opening (360) and cylinder (350). Accordingly, after this has been accomplished by the mechanism shown in FIG. 2, the drive lever (132) moves to the right bringing along with it cylinder (140) and rod (340) which will force material out of cylinder (350) through passageway (370) and passageway (372), the core member (354) having been turned to allow for the flow of liquid composition out of cylinder (350) into passageways (370) and (372) to allow the material to flow into passage tube (162) and from there into the empty caulking tube (66) so as to fill the empty caulking tube. The action of rod (340) with a piston at the end in cylinder (350) allows the liquid viscous composition to be inserted into caulking tube (66) through passage tube (162) in a rapid fashion. When the piston and cylinder (350) has travelled the desired travel as set by the measurements indicated in FIGS. 2 through 4, and as will be explained below, the core member (354) reverses its position and the piston and cylinder (350) is retracted to the left (as seen in FIG. 2) by rod (340), cylinder (140) and rocker arm (122) so as to allow material once more to enter the cylinder (350) from reservoirs (180) and (182) through passageway (360), the core member moving simultaneously to open a passageway between passageway (360) into cylinder (350). Accordingly, the cycle is repeated so as to fill six caulking tubes at a time on the caulking tube filling machine of the instant case in rapid and efficient fashion.

It should be noted that the amount of travel of lever (132) will determine the amount of travel of rod (340) and in turn will determine how much material is placed in cylinder (350) and is pushed out of cylinder (350) into the caulking tube. The amount of travel of lever (132) is determined by the rocking motion of rocker arm (122) and its similar member on the other side of the apparatus, as was referenced in the description of FIG. 1.

It should be noted, again, that arm (132) is connected to rocker arm (122) by means of a bushing (380) about pin (382). Accordingly, the amount of travel in rocker arm (122) will be determined by the amount of travel or rocking motion imparted by rocker arm (92). The amount of travel in arm (92) will determine the rotation or rocking of plate (230) about fixed shaft (240), the basic rocking motion having been imparted to fixed plate (230) by yoke (216) and to yoke (216) by lower drive lever (80) which is driven by shaft (36) through the appropriate cam arrangement as indicated previously. The fixed plate (230) is shown in a sort of a central position with respect to box (280) in FIG. 2. To explain the function of box (280) in fixed plate (230) reference is made to FIGS. 3 and 4 and the perspective view of FIG. 8, in which the box (280) is moved as far as you can to the right, as shown in FIG. 3, by means of screws (290), (292), (294), and (296). Incidentally, screws (290), (292), (294) and (296 impinge on cavities in plate (230), such cavities being (400), (402), (404) and (406). The reason for having cavities in fixed plate (230) for receiving the end of the screws is to prevent slippage of the screws on the plate. At any rate, by moving the box (280) to the extreme right in FIG. 3, eliptical member (302) is moved to the extreme right of eliptical space (300). This causes arm (92) to have a shorter swing or arc of travel about fixed shaft (240) and accordingly the travel of rocker arm (92) is shortened which shortens the travel of rocker arm (122) which shortens the travel of drive lever (132) and accordingly shortens the travel of the piston and the cylinder (350) which receives the composition.

FIG. 3 shows the extreme position in which the travel of upper drive lever (92) can be shortened about shaft (240) and, thus, shows the shortest travel that the apparatus can be adjusted to by adjusting means (82) for the travel of upper drive lever (92) and thus rocker arm (122) and lever (132) and accordingly the piston in cylinder (350) and shows the smallest amount of composition that the apparatus will fill caulking tubes with.

FIG. 4 shows the other extreme where the box means (280) is moved all the way to the right. With respect to plate (230), it should be noted that yoke (216) is fixed in relative motion to plate (230). Accordingly, going to FIG. 4, the box (280) is moved extremely to the right by means of screws (290), (292), (294) and (296) which causes eliptical member (302) to move to the left in eliptical space (300) in fixed plate (230). This causes an increase in the distance between fixed shaft (240) in plate (230) and pin (306) of arm (92) and, of course, eliptical member (302) which is appended to arm (92) in a fixed relationship thereto. In this fashion of FIG. 4, the upper drive lever (92) is the furtherest away from the position of fixed shaft (240) on plate (230). The arc of travel of arm (92) will be the largest that is possible with adjusting means of this apparatus and accordingly rocker arm (122) will travel the furtherest moving lever (132) the furtherest distance which will move cylinder (140) and the piston and cylinder (350) through the greatest distance and will fill the caulking tube with a maximum amount of composition that is possible to fill a caulking tube with the apparatus of the instant invention and with the adjusting means of the instant invention.

It should be noted that eliptical member (302) will not move in eliptical space (300) once the screws are set in a certain position. The turning and setting of the screws permits the fixed plate (230) to be in a fixed position relative to box (280) and accordingly fixes the position of eliptical member (302) and upper drive lever (92) with respect to fixed plate (230) for that setting of the screws. FIG. 2 shows the eliptical member (302) being in an intermediate sort of position with respect to eliptical space (300), while FIGS. 3 and 4 shows either extreme.

As can be appreciated, yoke (216) is in a fixed position with respect to fixed plate (230), that is, pin (222) will not move relative to fixed plate (230) either vertically or horizontally. While yoke (216) will impart motion to fixed plate (230) it will not move relative thereto, as is the case with eliptical member (302) and lever (92) with respect to fixed plate (230).

Utilizing this adjusting means disclosed in the instant case, the adjusting means can take a very heavy load and specifically loads for caulking tube filling apparatuses for filling caulking tubes with silicone compositions of even the highest viscosity. By this adjustment, the stroke of lever (132) can be changed by plus or minus one inch from the center of the stroke but from the practical point this much travel or the extreme of the travel is not needed. Thus, caulking tubes can be filled with this apparatus from $9\frac{1}{2}$ inch height to a low of $6\frac{1}{2}$ inches with an accuracy of 0.5 weight percent of composition.

Another improved aspect of the instant case is the use of ball bearings (202) around cam (200) which moves in cam follower (204). This use of ball bearings reduces the wear of the apparatus and results in prolonged wear without the necessity for additional lubrication. The prior art apparatuses did not use ball bearings in this area of the apparatus in the caulking tube filling machines.

Figure 9:
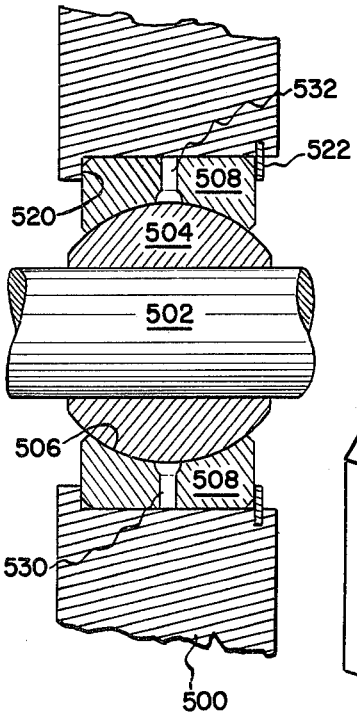
FIG. 9 is a partially cross-sectional view of the ball bushings that are utilized in the instant invention to reduce wear between moving parts in the linkage means of the instant invention.
Figure 8:
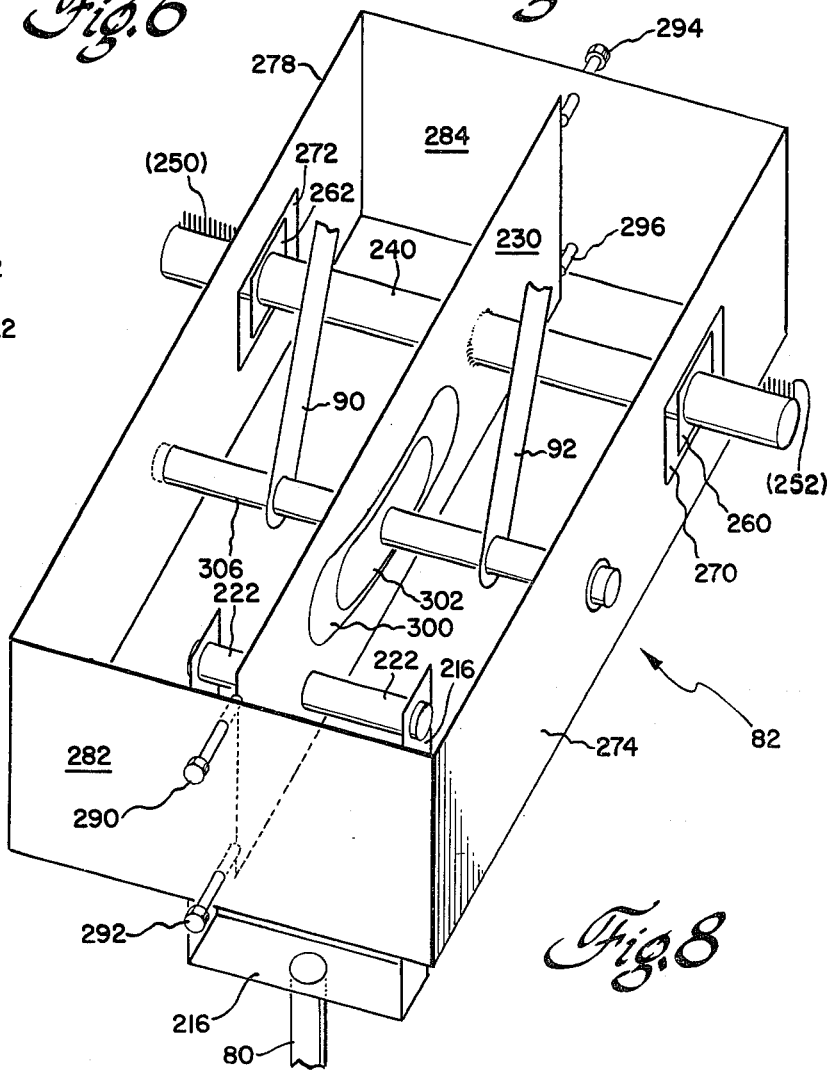
FIG. 8 is a perspective view of the adjusting means of the instant invention.

In addition, as has been noted in the instant case, there has been utilized ball bushings in various parts of the linkages. Such ball bushings were not used in previous machines and are advantageous in that they allow the excellent motion between the moving parts and even allow some lateral motion of the parts without anything breaking and without detracting from the efficiency and accuracy of the operation of the adjusting means and the rest of the apparatus. Before to accomplish the same thing there was utilized bronze and steel fittings which would not hold with the pressures on the lubricant and would also wear away periodically, frequently resulting in down-time of the machine for repair purposes. Such costly repairs have been eliminated by the use of steel and by the use of steel bushings in accordance with the disclosure above and below for reducing wear and for prolonging the operation of the machine with a minimum of repairs. An example of a ball bushing that is utilized in the apparatus of the instant case is to be seen in FIG. 9. Generally, such ball bushings comprises a central ball through which a shaft or pin which is appended to the moving parts moves relative to surface or area (500), the shaft being (502). About the shaft there is located circumferential or circular fitting (504) which fits in a concave opening (506) of appendage (508). Appendage (508) is retained in member (500) by shoulder (520) against which it rests and ring (522) which keeps it in place. Concave member (508) retains ball (504) in place by means of surface area or its concavity at (506). Accordingly, shaft (502) is free to rotate (as being attached to ball (504)) along concave surface (506) of member (508) and it is even capable of vibrating from one side or the other without breaking the linkage. Accordingly, ball (504) is capable of moving along concavities (506) of member (508) without undue wear and without breaking of any of the parts. All of the materials in the construction are of high quality steel, that is, the member (508) and ball (504) being of alloy steel. In concave member (508) there is provided channels (530) and (532) for the passage of lubricant against ball (504) so that it may be properly lubricated in its movement against member (508) in the apparatus. Accordingly, with such ball bushings, there results an apparatus of the instant case which undergoes prolonged wear without the necessity for replacing the ball bushings and without the necessity of repairing the apparatus resulting in a more efficient and less expensive operation of caulking tube filling machines and specifically the caulking tube filling machine of the instant case. As can be appreciated, the use of ball bearings in the cam and cam follower and the use of ball bushings in the areas indicated in the instant case; the use of such ball bushings is not new by itself but is new in the instant apparatus, that is, in the caulking tube filling machine. As a result there is a saving in expense in the operation of the machine and an increase in efficiency of the operation of the machine.

I claim:

1. An apparatus for filling caulking tubes with liquid compositions and with improved adjusting means for determining the amount of liquid composition being placed in the caulking tubes, comprising, a frame, drive means in the lower end of said frame for driving a conveyor belt means with empty caulking tubes placed thereon;

feed means being driven by said linkage means for passing said liquid composition into the empty caulking tubes on said conveyor belt means where the amount of said composition placed into said caulking tubes is determined by the travel in said linkage means wherein said linkage means and adjusting means comprises cam and lever means driven by said drive means said cam and lever means connected to and driving said adjusting means which is a plate which reciprocates at its rear end on a fixed shaft surrounded by box means wherein said plate is adjusted and maintained in position in said box means by screw means and such that the upper drive lever which drives said feed means is connected in a fixed position on said box means but is slideably connected to said plate means such that said cam and lever means will drive the forward end of said plate means in a reciprocating motion which will be transmitted to said upper lever to reciprocate said upper drive lever and the amount of reciprocating motion transmitted to said upper drive lever will depend on the lateral position of said plate means in said box means which is determined by said screw means and which determines the amount of travel of said upper drive lever about the fixed shaft to which said plate means is connected.

2. The apparatus of claim 1 wherein said cam and lever means comprises a cam driven by said drive means in a cam follower which is connected to and drives a lower drive lever wherein said cam moves in ball bearings located in said cam follower.

3. The apparatus of claim 2 wherein said lower drive lever is fixedly connected to the forward end of said plate means by means of a ball bushing.

4. The apparatus of claim 3 wherein said plate means reciprocates on a fixed shaft wherein said fixed shaft is connected to the rear end of said plate means and said box means sliding forward and rearward with respect to said fixed shaft.

5. The apparatus of claim 4 wherein said screw means comprises first and second screw means on either end of said plate means wherein said plate means meets said box means.

6. The apparatus of claim 5 wherein said screw means comprises two screws which threadably engage said box means, the ends of the screws impinging on the ends of said plate means.

7. The apparatus of claim 6 wherein said fixed shaft on said plate means slides in said box means by means of blocks located on said shaft and moving in rectangular openings in said box means.

8. The apparatus of claim 7 wherein said upper drive lever is connected by ball bushing to an eliptical member means which rides and slides as is necessary on an eliptical cut-out area in said plate means, and wherein said upper drive lever is connected to a secondary shaft which passes through said eliptical member means and is in a fixed position with respect to said box means wherein once said screw means have been adjusted there is no slideable movement of said eliptical member with respect to said plate means, wherein the adjustment of said eliptical member in said plate means by said screw means will determine the amount of reciprocation imparted to said upper drive lever by said lower drive lever about said fixed shaft on said plate means and as a result the amount of liquid composition placed in said caulking tubes by said feed means.

9. The apparatus of claim 8 wherein upper drive lever is connected by a ball bushing to a rocker arm means which reciprocates about on upper fixed shaft and drives a feed lever which activates the feed means.

10. The apparatus of claim 9 wherein the feed means comprises a cylinder which is reciprocated by said feed lever and is connected to feed lever by a ball bushing which reciprocates six pistons in cylinders wherein the amount of travel of the piston determines how much composition is driven in said cylinders and the amount of said composition which is deposited in the empty caulking tubes.

11. Improved linkage means for determining the amount of travel or reciprocating motion of a driven upper lever in said linkage means, comprising said linkage means having adjusting means therein wherein said linkage means comprises a cam and lever means connected and driving said adjusting means wherein said adjusting means comprises a plate means which reciprocates at its rear end on a fixed shaft surrounded by a box means wherein said plate means is maintained and adjusted in box means by screw means and such that the upper drive lever which is driven and is connected in a fixed position on said box means but is slideably connected to said plate means such that such cam and lever means will drive the forward end of said plate means in a reciprocating motion which will be transmitted to said upper lever to reciprocate the upper lever means and the amount of reciprocating motion transmitted to said upper lever will depend on the lateral position of said plate means in said box means which is determined by said screw means and which determines the amount of travel of said upper drive lever about the fixed shaft to which the plate means is connected.

12. The improved linkage means of claim 11, wherein said cam and lever means comprises a cam driven by said drive means in a cam follower which is connected to and drives a lower drive lever where said cam moves in ball bearings which are located in said cam follower.

13. The improved linkage means of claim 12 wherein said lower drive lever is fixedly connected to the forward end of said plate means by means of a ball bushing.

14. The improved linkage means of claim 13 wherein said plate means reciprocates on a fixed shaft wherein said fixed shaft is connected to the rear end of said plate means such that said box means can slide forward or rearward with respect to said fixed shaft.

15. The improved linkage means of claim 14 wherein said screw means comprises first and second screw means on either end of said plate means wherein said plate means meets said box means.

16. The improved linkage means of claim 15 wherein the screw means of said adjusting means comprises two screws which threadably engage the box means and the ends of such screws impinge on the end of said plate means.

17. The improved linkage means of claim 16 wherein said adjusting means has therein a fixed shaft in said plate means about which slides in said box means by means of blocks located on said shaft, the box moving in rectangular openings in said box means.

18. The improved linkage means of claim 17 wherein said improved adjusting means comprises an upper drive lever which is connected by a ball bushing to an eliptical rider member which rides and slides as is necessary in the eliptical cut-out area in said plate means and wherein said upper drive lever is connected to a secondary shaft which passes through said eliptical member and is in a fixed position with respect to said box means and wherein once said screw means have been adjusted there is no slideable movement of said eliptical member with respect to said plate means wherein the adjustment of said eliptical member in said plate means by said screw means will determine the amount of reciprocation imparted to said upper drive means by said lower drive lever about said fixed shaft on said plate means.

19. Improved adjusting means for determining the amount of travel or reciprocating motion that a lower drive lever imparts to an upper drive lever in a linkage means comprising a lower drive lever having cam and lever means and said adjusting means comprises a plate means which reciprocates at its rear end on a fixed shaft surrounded by a box means wherein said plate means is maintained and adjusted in position in said box means by screw means such that the upper drive lever which is connected in a fixed position on said box is slideably connected to said plate means such that the cam and lever means will drive the forward end of said plate means which motion will be transmitted to said upper lever to reciprocate said upper lever in a reciprocating motion, the amount of reciprocating motion transmitted to said upper drive lever will depend on the lateral position of said plate means on said box means which is determined by said screw means and which determines the amount of travel of the upper drive lever about the fixed shaft to which the plate means is connected.

20. The improved adjusting means of claim 19 wherein said cam and lever means comprises a cam driven by drive means and a cam follower which is connected to and drives a lower drive lever wherein said cam moves in ball bearings located on said cam follower.

21. The improved adjusting means of claim 20 wherein said lower drive lever is affixedly connected to the forward end of said plate means by means of a ball bushings.

22. The improved adjusting means of claim 21, wherein said plate means reciprocates on a fixed shaft wherein said fixed shaft is connected to the rear end of said plate means and such that said box means can slide forward or rearward with respect to said fixed shaft.

23. The improved adjusting means of claim 22, wherein said screw means comprises first and second screw means at either end of said plate means wherein said plate means meets said box means.

24. The improved adjusting means of claim 23, wherein said screw means comprises two screws which threadably engage said box means and the ends of such screws impinge on the ends of said plate means wherein said plate means is located within said box means.

25. The improved adjusting means of claim 24, wherein said fixed shaft on said plate means slides in said box means of blocks located on said shaft and moving in rectangular openings in said box means.

26. The improved adjusting means of claim 25, wherein said upper drive lever is connected by ball bushings to an eliptical rider member which rides and slides, if necessary, in an eliptical cut-out area in said plate means and wherein said upper drive lever is connected to a secondary shaft which passes through said eliptical member and is in a fixed position with respect to the box means wherein once said screw means has been adjusted there is no slideable movement of said eliptical member with respect to said plate means and wherein the adjustment of said eliptical member in said plate means by said screw means will determine the amount of reciprocation imparted to said upper drive lever by said lower drive lever about said fixed shaft on said plate means and will, thus, correspondingly determine the amount of reciprocating motion imparted to said upper drive lever by said lower drive lever.

* * * * *